US009027816B2

(12) United States Patent
Dittrich et al.

(10) Patent No.: US 9,027,816 B2
(45) Date of Patent: May 12, 2015

(54) FASTENER DRIVING TOOL

(76) Inventors: Tilo Dittrich, Feldkirch (AT); Heeb Norbert, Buchs (CH); Simon Beauvais, Horbranz (AT)

( * ) Notice: Subject to any disclaimer, the term of this patent is extended or adjusted under 35 U.S.C. 154(b) by 765 days.

(21) Appl. No.: 13/302,411

(22) Filed: Nov. 22, 2011

(65) Prior Publication Data

US 2012/0132690 A1 May 31, 2012

(30) Foreign Application Priority Data

Nov. 25, 2010 (DE) ..... 10 2010 061 973

(51) Int. Cl.

| | |
|---|---|
| ***B21J 15/28*** | (2006.01) |
| ***B27F 7/17*** | (2006.01) |
| ***B25C 1/12*** | (2006.01) |
| ***B25C 1/14*** | (2006.01) |
| ***B25C 1/08*** | (2006.01) |

(52) U.S. Cl.

CPC ..... *B25C 1/08* (2013.01)

(58) Field of Classification Search

USPC ..... 227/1–11, 130; 173/104–108, 200–201, 173/217, 218

See application file for complete search history.

(56) References Cited

U.S. PATENT DOCUMENTS

| | | | | |
|---|---|---|---|---|
| 4,176,638 | A * | 12/1979 | Kitamura et al. | 477/111 |
| 4,200,213 | A * | 4/1980 | Liesse | 227/10 |
| 4,377,991 | A * | 3/1983 | Liesse | 123/46 SC |
| 4,403,722 | A * | 9/1983 | Nikolich | 227/8 |
| 4,483,280 | A * | 11/1984 | Nikolich | 123/46 SC |
| 4,483,474 | A * | 11/1984 | Nikolich | 227/8 |
| 5,199,626 | A * | 4/1993 | Terayama et al. | 227/10 |
| 5,263,439 | A * | 11/1993 | Doherty et al. | 123/46 SC |
| 6,223,963 | B1 | 5/2001 | Aparacio, Jr. | |
| 6,552,472 | B1 * | 4/2003 | Heinz | 310/328 |
| 6,634,325 | B1 | 10/2003 | Adams | |
| 6,895,914 | B2 * | 5/2005 | Rado et al. | 123/179.11 |
| 6,988,469 | B2 | 1/2006 | Schiestl et al. | |
| 7,588,096 | B2 * | 9/2009 | Panasik | 173/108 |
| 7,743,955 | B2 * | 6/2010 | Nishikawa et al. | 227/9 |
| 7,926,690 | B1 * | 4/2011 | Tippmann, Sr. | 227/10 |
| 8,397,967 | B2 * | 3/2013 | Calvet et al. | 227/2 |
| 8,544,710 | B2 * | 10/2013 | Tanaka | 227/10 |
| 8,708,209 | B2 * | 4/2014 | Oouchi | 227/8 |
| 8,733,610 | B2 * | 5/2014 | Pedicini | 227/130 |
| 8,746,197 | B2 * | 6/2014 | McAlister | 123/143 B |

(Continued)

FOREIGN PATENT DOCUMENTS

| | | |
|---|---|---|
| DE | 10260703 A1 | 7/2004 |
| DE | 103 55 375 A1 | 6/2005 |

OTHER PUBLICATIONS

German Office Action, Application No. 10 2010 061 973.6, mailed Aug. 24, 2012.

*Primary Examiner* — Robert Long

(57) ABSTRACT

The invention relates to a fastener driving tool comprising a tank (5) for storing a fuel, in particular liquefied petroleum gas, a combustion chamber (2) connected to the tank (5), wherein the combustion chamber (2) has a movable piston for powering a driving plunger, and a metering device (4) arranged between the tank (5) and the combustion chamber (2) wherein a defined quantity of fuel can be transported by means of the metering device (4) from a metering space (12) into the combustion chamber (2), wherein the metering device (4) comprises a thermomechanical element (15) by means of which the defined amount can be varied as a function of a temperature.

18 Claims, 3 Drawing Sheets

(56) References Cited

U.S. PATENT DOCUMENTS

| | | | | |
|---|---|---|---|---|
| 8,752,524 | B2 * | 6/2014 | McAlister | 123/297 |
| 8,800,681 | B2 * | 8/2014 | Rousson et al. | 173/144 |
| 2004/0187810 | A1 | 9/2004 | Gschwend et al. | |
| 2005/0109812 | A1 | 5/2005 | Ehmig et al. | |
| 2010/0230461 | A1 * | 9/2010 | Tanaka | 227/9 |
| 2011/0000206 | A1 * | 1/2011 | Aprad | 60/517 |
| 2011/0068141 | A1 * | 3/2011 | Wolf et al. | 227/9 |
| 2011/0079624 | A1 * | 4/2011 | Oiwa et al. | 227/9 |
| 2011/0101064 | A1 * | 5/2011 | Wolf et al. | 227/9 |
| 2011/0139848 | A1 * | 6/2011 | Rousson et al. | 227/10 |
| 2012/0132687 | A1 * | 5/2012 | Dittrich et al. | 227/10 |
| 2013/0270319 | A1 * | 10/2013 | Gauger et al. | 227/2 |
| 2014/0130756 | A1 * | 5/2014 | McAlister | 123/1 A |

* cited by examiner

FASTENER DRIVING TOOL

BACKGROUND OF THE INVENTION

The invention relates to a fastener driving tool, more particularly a hand-held fastener driving tool according to the preamble of claim 1.

DE 102 60 703 A 1 describes a liquefied petroleum gas-driven fastener driving tool that has a metering chamber with an adjustable metered volume. The metered volume can be varied by an electric motor drive, and an ejection of liquefied petroleum gas into a combustion chamber is initiated by a pneumatic drive by means of compressed air.

BRIEF SUMMARY OF THE INVENTION

The problem of the invention is to specify a fuel driven fastener driving tool that allows an adjustment to variable operating conditions.

This problem is solved for a fastener driving tool of the type mentioned above by the characterizing features of claim 1. The temperature-dependent variation of the quantity of fuel introduced into the combustion chamber guarantees reliable ignition and a uniform functioning of the fastener driving tool in a simple manner, even if the ambient temperatures or operating temperatures for the tool change. Depending on requirements, the relevant temperature can be, for example, the temperature in the area of or inside of the combustion chamber, or the ambient temperature of the tool.

It is taken into consideration that, especially if liquefied petroleum gas is used as the fuel, a phase change is required in order to produce an ignitable gas-air mixture, the kinetics of this process being influenced significantly by the prevailing temperatures. A generally known procedure, for example, is to increase the quantity of liquefied petroleum gas introduced into the combustion chamber at low ambient temperatures in order to be able to provide a sufficient amount of ignitable gas in a sufficiently short time.

A thermomechanical element within the meaning of the invention is to be understood as any component that achieves a controlled mechanical effect directly by changing its temperature, without the need for the thermomechanical element to use other energy sources such as electric batteries.

In a preferred embodiment, it is provided that the metered volume can be changed by the thermomechanical element. This yields a particularly simple and effective configuration of the invention that allows, for example, easy metering by measuring the fuel in an adjustable metering space as an intermediate storage area by opening and closing valves connected to the variable metering space. The thermomechanical element can be provided as a body in the metering space or can act as an actuator that varies an adjustable wall or diaphragm of the metering space.

In an alternative or supplementary embodiment of the invention, the metering device comprises a movable displacement member for ejecting the defined amount of fuel, with the stop position of the displacement member being variable by the thermomechanical element. These embodiments generally have the advantage that the displacement member enables a particularly rapid transport of the fuel into the combustion chamber. In particular, such a displacement member can, but need not necessarily, be constructed as a linearly displaceable piston or the like. The metered amount of fuel can be the product of the piston stroke and its cross-sectional area, the piston stroke being variable by means of the variable stop.

It is preferably assumed within the meaning of the present invention that the fuel is metered predominantly or exclusively in the liquid phase, whereby the amount of fuel introduced into the combustion chamber is defined especially precisely. With liquefied petroleum gas as the fuel, such an exclusive metering in the liquid phase can be ensured, for example, by arranging a diaphragm in the fuel tank, wherein the liquefied petroleum gas is kept exclusively in the liquid phase inside the diaphragm and an inert gas under a defined positive pressure is provided outside the diaphragm, for example. As the fuel is consumed, the inert gas expands due to its positive pressure and keeps the liquefied petroleum gas in the liquid phase at all times. Such a conventionally known configuration of a fuel tank is accompanied in practice as a matter of course by a certain variation of the pressure in the fuel tank as it is being emptied. That constitutes a difference from conventional storage containers for liquefied petroleum gas, in which liquefied gas is stored in a coexistence of gaseous and liquid phases in a constant volume, and thus provides a constant pressure.

In another preferred detailed design of the invention, a drive mechanism of the displacement member can be powered via a pressure of the fuel, in particular via a connection to the fuel tank. This makes it possible to forgo additional drive mechanisms, such as electrical and pneumatic drives, for the displacement member cost-effectively. Finally, the mechanical energy stored in the fuel tank is intelligently used to enable the metering of the fuel into the combustion chamber quickly and precisely.

In another detailed design, the displacement member can be held in an initial position under a force, preferably but not necessarily by means of a spring. In a simple manner, this ensures a defined starting position of the displacement member before initiation of the metering process.

In one possible embodiment of the invention, the thermomechanical element is constructed as a bimetallic member. Preferably, but not necessarily, this can be a bimetallic disk as is conventionally known. Such bimetallic members operate according to the known principle of fixing two metals or other materials with different coefficients of thermal expansion to one another, particularly by material bonding. In case of changes of temperature, considerable and defined deformations occur, such as bulging of the bimetallic disk, and also a mechanically induced stroke of considerably larger extent than the purely thermal expansion of a homogeneous metal piece of the same size.

In an alternative or supplementary embodiment, the thermomechanical element can also comprise an expansion material compound. The expansion material can be a liquid or a pasty compound, in particular a wax. This compound is arranged in a suitable device in which an isotropic volume expansion of the expansion material is converted into a defined stroke or the like. In one of the possible embodiments of the invention, such an expansion compound, enclosed in a diaphragm if appropriate, can be arranged in the metering space, whereby the metering space that can be filled by the fuel can be varied as a function of an expansion of the expansion material. In alternative configurations, the thermomechanical element can preferably be constructed as a thermal actuator that comprises a temperature-dependently positioned tappet. Such thermal actuators are conventionally known and are offered for other application purposes. The tappet can be connected to a movable wall of the metering space or can be used as a variable stop for a movable displacement member.

In a generally advantageous detailed design, the metering device comprises at least one valve member, the valve member being preferably driven electrically. Further advantageously, the valve member can be constructed as a three-way valve, in particular with two switching positions, in the interest of a simple and effective realization. Overall this allows a simple and reliable control of the metering device. Further advantageously, the two switching positions of the three-way valve can be configured as bistable positions, whereby a particularly low consumption of electric energy for the valve member becomes possible.

It is provided in a generally advantageous manner that a characteristic curve of the defined fuel quantity as a function of an ambient temperature has a substantially bilinear progression. This can be advantageously used so that the metered fuel quantity is varied only in the low temperature range, for example, while a constant amount of fuel is metered after reaching a certain limit temperature, in the range of an ambient temperature of 20° C., for example. With suitable mechanical measures, the thermomechanical element can also vary at temperatures higher than the limit temperature without an influence on the metered quantity of fuel.

Another possible embodiment of the invention provides that the thermomechanical element comprises a remote sensor. In this way, the metered amount can be influenced as a function of a temperature that does not appear directly in the area of the mechanical connection of the thermomechanical element to the metering device. In particular, this can be the temperature in or in the vicinity of the combustion chamber, the remote sensor being arranged on the combustion chamber and a metering device being arranged a distance away from the combustion chamber. Such a remote sensor can comprise, for example, a relatively larger container positioned in the vicinity of the temperature source and a smaller, deformable container in the area of the metering device, the two containers being connected by a capillary tube. The volume ratios of the two containers then allow the system to react substantially to the temperature of the larger container.

Depending on the detailed design, a suitable mechanical transmission can be connected between the thermomechanical element, such as an expansion material element, and the metering space, in order to achieve a more precise adaptation of a characteristic curve of the thermomechanical element to a desired temperature-dependent characteristic curve of the metering space. In this way, nonlinear relations can also be achieved if necessary, for example by means of connecting link discs or other measures.

Further advantages and characteristics of the invention follow from the embodiment examples described below, and from the dependent claims.

BRIEF DESCRIPTION OF THE SEVERAL VIEWS OF THE DRAWINGS

Several embodiment examples of the invention will be described below and explained in detail with reference to the attached drawings.

DETAILED DESCRIPTION OF THE INVENTION

Figure 1:
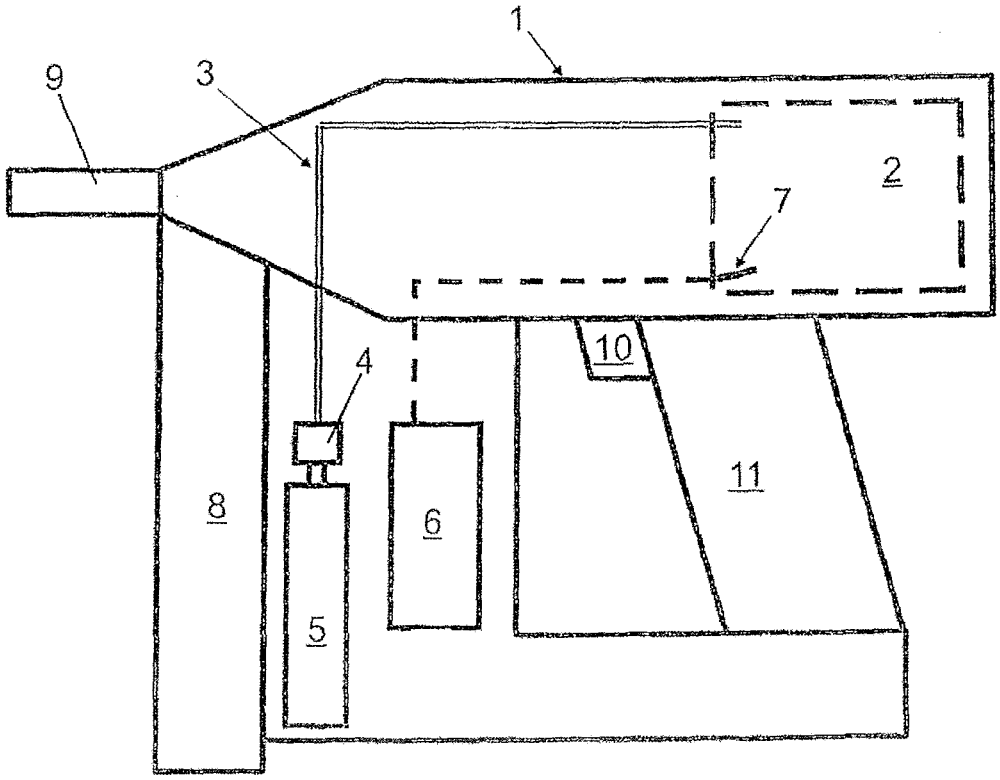
FIG. 1 shows a schematic overall view of a fastener driving tool according to the invention.

The fastener driving tool shown schematically in FIG. 1 comprises a housing 1 in which a combustion chamber 2 is arranged. Liquefied petroleum gas is stored as fuel in a fuel tank 5 and can be injected into the combustion chamber 2 via a line 3. The line 3 connects a metering device 4 to the combustion chamber 2, the metering device 4 being in turn connected to a fuel tank 5 arranged in or on the housing 1. In particular, the fuel tank can be constructed as a replaceable cartridge.

The fastener driving tool further comprises an electronic controller 6 with an electrical storage battery as the energy source. The electronic controller 6 controls a spark plug 7 in the combustion chamber 2, and optionally the metering device 4 as well, if the latter has electric valves or other electrically controlled opponents. A magazine 8 for storing fastening means such as nails is arranged in an anterior area of the driving tool. A contact member 9 can be pressed against a workpiece in order to enable triggering of the fastener driving tool.

A fastening member from the magazine 8 is driven in by the ignition of a liquid petroleum gas-air mixture in the combustion chamber 2 by means of the spark plug 7, after which a piston (not shown) is driven forward and drives the fastening member or the nail into the workpiece via a driving plunger (not shown). This driving process is initiated by an operator via a switch 10, which is arranged in a handle area 11 of the housing 1 in this case.

Figure 2:
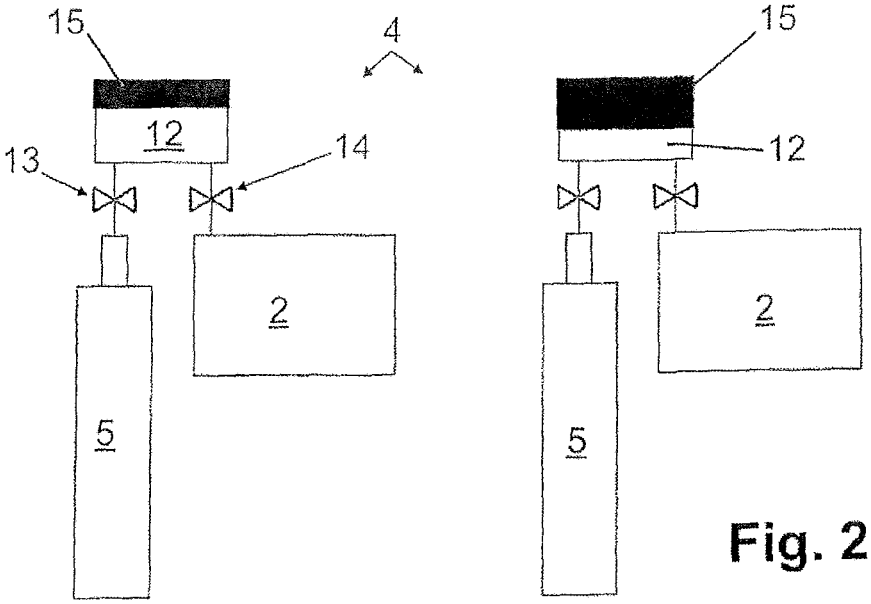
FIG. 2 shows a schematic representation of a first embodiment of the invention at low and high temperatures.

FIG. 2 shows a first embodiment example of the metering device 4. The metering device 4 comprises a metering space 12 that is connected via an input-side electrically controllable valve 13 to the fuel tank 5 and via an output-side electrically controllable valve 14 to the combustion chamber 2.

A thermomechanical element 15, comprising an expansion material compound in the present case, is located in on the metering space. Depending on the temperature prevailing in the metering space or the environment, the expansion material compound 15 expands more or less, so that the remaining volume that can be filled with liquefied petroleum gas is smaller at high temperatures than at low temperatures. This is illustrated by a comparison of the illustration (low temperature) on the left and that on the right (higher temperature). Different variants are possible for the precise configuration of the arrangement of the expansion material compound in the metering space. For example, the expansion material compound can be enclosed in an elastic diaphragm that is inert relative to the liquid petroleum gas and can then be located in the metering space. An elastic or movable wall can also be provided on the metering space, in which case the expansion material compound is located on the other side of the wall. In such an arrangement, a bimetallic member such as a bimetallic disk can be provided in place of the expansion material compound in order to change the size of the metering space by shifting or deforming the wall of the metering space.

The metering device according to FIG. 2 functions as follows:

First the input-side valve 13 is opened by means of the controller 6, so that liquefied petroleum gas can flow in a liquid phase into the metering space. The liquefied petroleum gas in tank 5 is only present in the liquid phase. This is accomplished in a conventional manner by enclosing the liquefied petroleum gas in the tank in a diaphragm and filling the area outside the diaphragm with an inert gas under a pressure higher than the vapor pressure of the liquefied petroleum gas. Due to this positive pressure, no evaporation process takes place following the flowing of the liquefied petroleum gas into the metering space 12, so that there is substantially no change of temperature following the flowing of the liquid gas.

When the fastener driving tool is triggered, the input-side valve 13 is closed and the output-side valve 14 is opened so that the liquid petroleum gas can flow into the combustion chamber 2. The amount of liquid metered into the combustion chamber 2, depending on the expansion of the thermomechanical element 15, is larger at lower temperatures, so that even with a slower evaporation, an ignitable mixture is provided in the combustion chamber 2 sufficiently quickly.

FIGS. 3*a* through 4*b* show a second embodiment example of the invention. An essential difference from the previous embodiment example is that the liquefied petroleum gas is ejected from the metering space 12 by means of a movable displacement member 16.

The displacement member 16 is constructed as a linearly movable piston located in a cylinder 17 that is part of the metering space 12. The cylinder 17 adjoins an electrically driven valve member 18 that also has a connection to the fuel tank 5 and a connection to the combustion chamber 2 in addition to its connection to the cylinder 17. A valve slide 19 closes either the connection 18*a* to the fuel tank 5 or the connection 18*b* to the combustion chamber 2. Overall, the valve member 18 is constructed as a 3-way valve with two valve positions.

Depending on requirements, the positions of the valve slide 19 can each be stable positions (bistable valve slide) so that only a short electrical pulse requiring little energy is necessary to change the valve over. In another embodiment, the valve slide 19 is always arranged as in FIG. 3*a* in a deenergized rest position, i.e., closing the connection 18*b* to the combustion chamber 2 (monostable valve slide). By applying an electrical voltage, the valve slide is brought into the opposite position (see FIG. 3*b*), in which it closes the connection 18*a* to the fuel tank 5.

In each position of the valve slide 19, the cylinder 17 of the metering space 12 remains connected to the valve member 18. The valve member 18 comprises a certain intrinsic volume, which contributes to the metering space 12.

A branch line 20 leads from the connection of the fuel tank 5 and valve member 18 to an end of the cylinder 17 facing away from the valve member 18. The branch line 20 connects an upper end of the piston-like displacement member 16 to the fuel tank.

A thermomechanical element 15 that provides a temperature-dependent upper stop for the displacement member 16 is also arranged in this upper end area of the cylinder 17.

Figure 3A:
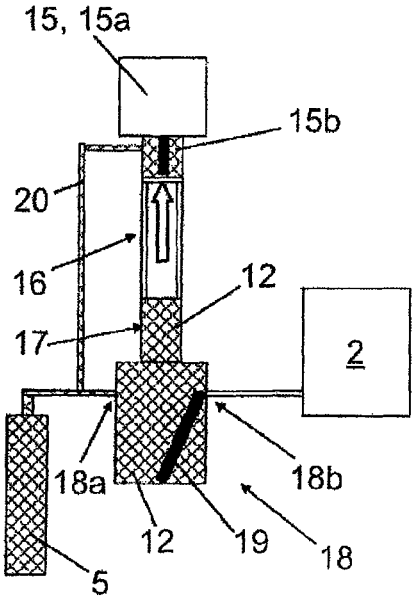
FIG. 3*a* shows a second embodiment example of the invention at high temperatures in a standby state of the metering device.
Figure 3B:
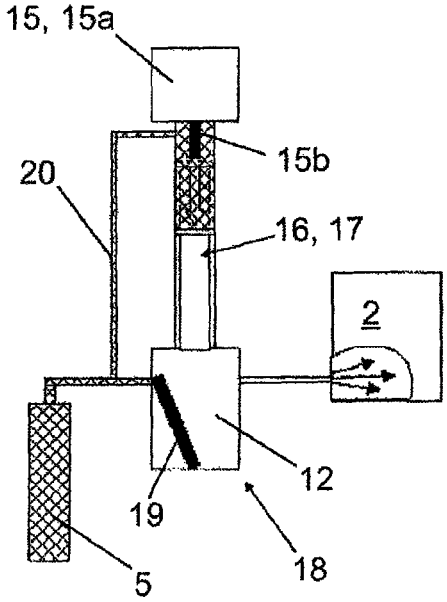
FIG. 3*b* shows the embodiment example from FIG. 3*a* during a metering of the fuel.

According to the representation in FIG. 3*a*, which corresponds to a high ambient temperature, the stop is provided by a temperature-dependently movable stop pin 15*a*. In addition to the stop pin 15*a*, a second stop 21, which is fixed or movable by other means such as manual adjustment depending on requirements, is provided. This second stop 21 defines the highest position of the displacement member 16 at warm temperatures; see FIGS. 4*a* and 4*b*. A temperature-dependent variation of this second stop 21 is consequently not provided.

Figure 4A:
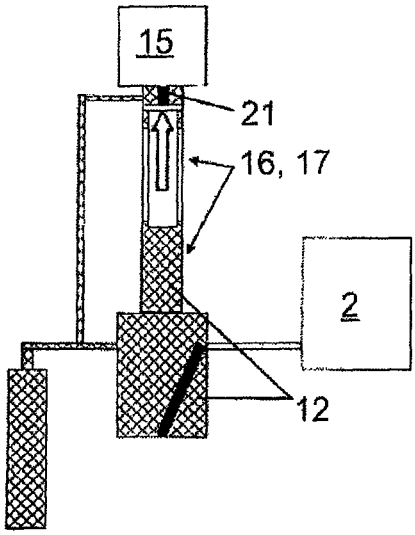
FIG. 4*a* shows the embodiment example from FIG. 3*a* at low temperatures.
Figure 4B:
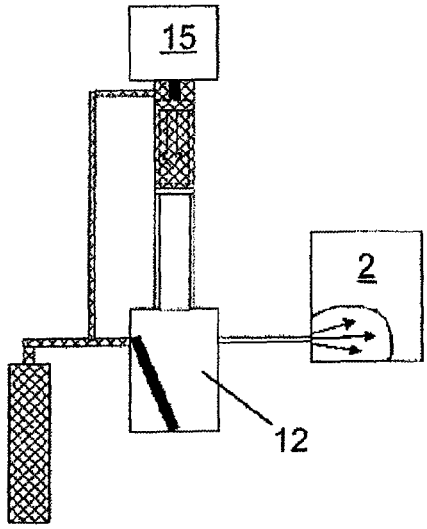
FIG. 4*b* shows the embodiment example from FIG. 4*a* during a metering of the fuel.

The piston 16 is also tensioned by means of a spring (not shown) into its upper stop position, as is symbolized by the upward-directed arrow in FIGS. 3*a* and 4*a*. In this starting position according to FIGS. 3*a* and 4*a*, the pressure of the fuel tank 5 is present in the cylinder 17 both above and below the piston 16. The spring force only serves to provide a defined positioning of the piston 16 in a starting position. The force of the positioning spring can accordingly be relatively small.

A triggering process of the fastener driving device now takes place by switching the valve slide of the valve member 19 into the opposite position. Thereby the lower part of the cylinder 17, which is connected to the valve member 18, is connected via the connection 18*b* to the combustion chamber 2, in which there is a considerably lower pressure (ambient pressure). Above the piston 16, the cylinder 17 continues to be subjected via the line 20 to the pressure in the fuel tank 5. Thereby the piston 16 is accelerated downward according to the drawings, or in the direction of the valve member 18, pressing the liquefied petroleum gas out of the metering space 12, i.e, the lower part of the cylinder 17 and the volume in the valve member 18, into the combustion chamber 2. After this process, the piston 16 has reached a lower stop position shown in FIGS. 3*b* and 4*b*. According to this process, the displacement member 16 is driven by the pressure of the fuel in the tank 5.

For clarity, the volume areas in which the liquefied petroleum gas is in equilibrium in the liquid phase or under high pressure are shown in FIGS. 3*a* through 4*b* with crosshatching.

Figure 6:
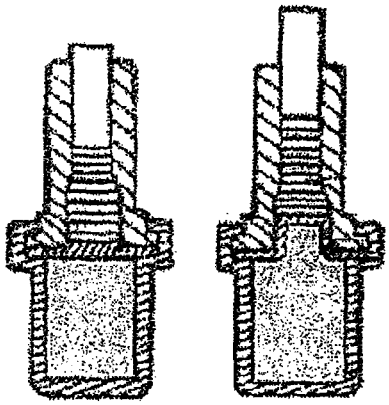
FIG. 6 shows a thermal actuator at two different temperatures.

The temperature-dependent change of the quantity of fuel injected into the combustion chamber is accomplished via the variable length of the stop part 15*a* of the thermomechanical element 15. The thermomechanical element 15 in the present case comprises an expansion material actuator 22 that is filled with an expansion material compound. Such expansion material actuators are commercially available and shown for the sake of example in FIG. 6.

Figure 5:
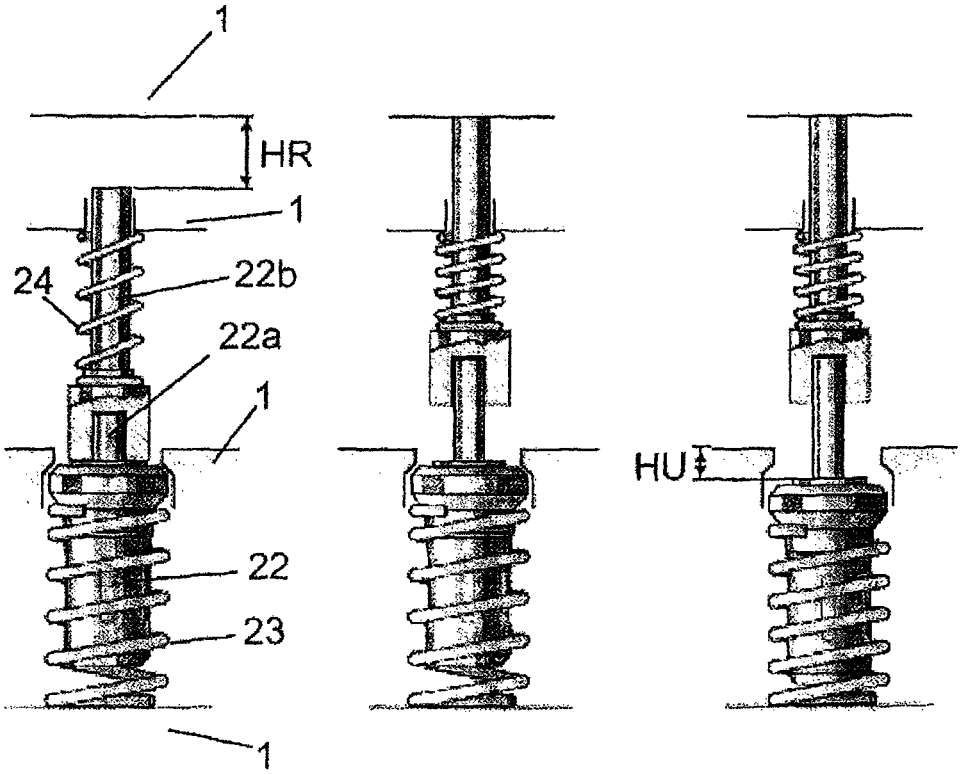
FIG. 5 shows a thermomechanical element of the embodiment example according to FIGS. 3*a*-4*b* in three different states.

FIG. 5 shows an especially preferred arrangement of the thermomechanical element 15, by means of which a bilinear characteristic curve of the metered volume versus temperature can be achieved with simple means. The expansion material actuator 22 is supported at one end via a first support spring 23 on a housing 1, its linearly movable tappet 22*a* being connected to an extension 22*b* which is in turn supported by means of a second spring 24 against the housing 1 in order to ensure a return of the tappet when the expansion material compound cools down.

A temperature-dependent change of the metering space can be accomplished via a stroke control range HR (see left illustration in FIG. 5). Starting from a certain temperature, the extension 22*b* strikes against a stop fixed to the housing, whereby a maximum reduction of the metering space is reached. Any further expansion of the expansion material or any further extension of the tappet 22*a* is then absorbed by a compression of the first spring 23, which has a function of an overstroke spring. The extension 22*b* and the tappet 22*a* remain stationary with respect to the housing.

The stroke exceeding the stop position (central illustration in FIG. 5) is thus an overstroke HU and is not used further for regulating the metering space. In this range, the characteristic curve of the metering space as a function of the temperature is thus a horizontal line, or the metering space is constant above this temperature.

In practice and when using ordinary liquefied petroleum gas such as propane or propane-butane mixtures, it has been found that a change of the metering space or the liquid petroleum gas amount introduced into the combustion chamber makes sense in ranges below roughly 20° C. to 25° C. At higher temperatures, such a regulation is no longer very effective and the metering space is preferably held constant in these temperature ranges.

A variation of the metering space in the range between −10° C. and +20° C. for hand-operated fastener driving tools is typically roughly 15 $mm^3$, which corresponds in suitable embodiments to a stroke of the thermomechanical element of 1 to 1.5 mm, which is easily realizable technically.

The invention claimed is:

1. A fastener driving tool, comprising a tank for storing a fuel, a combustion chamber connected to the tank, wherein the combustion chamber has a movable piston for powering a driving plunger which drives a fastener, and a metering device arranged between the tank and the combustion chamber, wherein a defined quantity of fuel can be transported by means of the metering device from a metering space into the combustion chamber, and wherein the metering device comprises a thermomechanical element comprising an expansion material compound comprising a thermo-actuator that comprises a temperature-dependently positioned tappet by means of which the defined quantity can be varied as a function of a temperature.

2. The fastener driving tool according to claim 1, wherein the metering space can be varied by the thermomechanical element.

3. The fastener driving tool according to claim 1, wherein the metering device comprises a movable displacement member for ejecting the defined quantity of fuel, and wherein a stop position of the displacement member can be varied via the thermomechanical element.

4. The fastener driving tool according to claim 3, wherein a drive mechanism of the displacement member can be driven by a pressure of the fuel via a connection to the tank.

5. The fastener driving tool according to claim 3, wherein the displacement member is held in an initial position under application of force by means of a spring.

6. The fastener driving tool according to claim 1, wherein the thermomechanical element comprises a bimetallic member.

7. The fastener driving tool according to claim 1, wherein the metering device comprises at least one valve member wherein the valve member is operated electrically.

8. The fastener driving tool according to claim 7, wherein the valve member comprises a 3-way valve.

9. The fastener driving tool according to claim 1, wherein a characteristic curve of the defined fuel quantity as a function of an ambient temperature has a substantially bilinear progression.

10. The fastener driving tool according to claim 1, wherein the thermomechanical element comprises a remote sensor.

11. The fastener driving tool according to claim 2, wherein the metering device comprises a movable displacement member for ejecting the defined quantity of fuel, and wherein a stop position of the displacement member can be varied via the thermomechanical element.

12. The fastener driving tool according to claim 11, wherein a drive mechanism of the displacement member can be driven by a pressure of the fuel via a connection to the tank.

13. The fastener driving tool according to claim 4, wherein the displacement member is held in an initial position under application of force by means of a spring.

14. The fastener driving tool according to claim 12, wherein the displacement member is held in an initial position under application of force by means of a spring.

15. The fastener tool of claim 6, wherein the bimetallic member comprises a bimetallic disk.

16. The fastener driving tool according to claim 2, wherein the metering device comprises at least one valve member wherein the valve member is operated electrically.

17. The fastener driving tool according to claim 8, wherein the 3-way valve has two switching positions.

18. The fastener driving tool according to claim 16, wherein the valve member comprises a 3-way valve.

* * * * *